US008245649B1

(12) United States Patent
Ratliff et al.

(10) Patent No.: US 8,245,649 B1
(45) Date of Patent: Aug. 21, 2012

(54) SPECIALIZED TABLE APPARATUS

(76) Inventors: Timothy S. Ratliff, Greenville, WI (US); Vicky Ratliff, Greenville, WI (US)

( * ) Notice: Subject to any disclaimer, the term of this patent is extended or adjusted under 35 U.S.C. 154(b) by 262 days.

(21) Appl. No.: 12/847,787

(22) Filed: Jul. 30, 2010

(51) Int. Cl.
*A47B 85/00* (2006.01)

(52) U.S. Cl. ..... 108/25; 108/27; 108/156

(58) Field of Classification Search ..... 108/25, 108/27, 33, 50.11, 153.1, 155, 156, 180, 108/186, 187, 93; 312/235.2, 239, 194–196; 446/476, 478, 479, 482; 280/87.051; 297/136
See application file for complete search history.

(56) References Cited

U.S. PATENT DOCUMENTS

| | | | | | |
|---|---|---|---|---|---|
| 841,700 | A | * | 1/1907 | Linden | 297/138 |
| 919,052 | A | * | 4/1909 | Miller | 312/285 |
| 1,109,785 | A | * | 9/1914 | Lampert | 52/440 |
| 1,270,575 | A | * | 6/1918 | Wheeler | 108/25 |
| 1,320,321 | A | * | 10/1919 | Preston et al. | 33/23.04 |
| 1,353,180 | A | * | 9/1920 | Preston et al. | 297/119 |
| 1,493,337 | A | * | 5/1924 | Grandjean | 312/27 |
| 2,291,373 | A | * | 7/1942 | Button | 297/136 |
| 2,297,647 | A | * | 9/1942 | Chason | 108/69 |
| D137,954 | S | * | 5/1944 | Puls | D6/480 |
| D146,796 | S | * | 5/1947 | Johnson | D6/453 |
| 2,461,715 | A | * | 2/1949 | Biggerstaff | 108/137 |
| 2,481,725 | A | | 9/1949 | Culley et al. | |
| 2,551,999 | A | * | 5/1951 | Ditty, Sr. | 297/125 |
| 2,588,754 | A | * | 3/1952 | Novi | 297/136 |
| 2,695,656 | A | * | 11/1954 | Wagman | 297/138 |
| 2,727,754 | A | * | 12/1955 | Webb | 280/79.2 |
| 3,055,722 | A | * | 9/1962 | Chase et al. | 108/27 |
| 3,236,003 | A | * | 2/1966 | Flood, Jr. | 446/110 |
| 3,592,506 | A | * | 7/1971 | Breslow | 297/188.1 |
| D244,113 | S | | 4/1977 | Friedman | |
| 4,212,130 | A | * | 7/1980 | Walker | 446/111 |
| 4,699,067 | A | * | 10/1987 | Okopny | 108/186 |
| D299,600 | S | | 1/1989 | Mollica | |
| 4,887,538 | A | * | 12/1989 | Arnold | 108/185 |
| 5,055,081 | A | * | 10/1991 | Nayak | 446/75 |
| 5,375,536 | A | * | 12/1994 | Peters | 108/6 |
| 5,592,884 | A | | 1/1997 | Glick et al. | |
| 5,615,619 | A | | 4/1997 | King | |
| 6,000,750 | A | | 12/1999 | Rossman et al. | |
| 6,321,662 | B1 | * | 11/2001 | Fraise | 108/25 |
| 6,595,143 | B2 | | 7/2003 | London | |
| 6,729,371 | B2 | * | 5/2004 | Sheahan et al. | 144/286.1 |
| 6,910,429 | B1 | * | 6/2005 | Matay et al. | 108/44 |
| 7,229,333 | B2 | * | 6/2007 | Bamesberger | 446/75 |
| 7,322,642 | B2 | * | 1/2008 | BoJack | 297/135 |
| 8,052,106 | B2 | * | 11/2011 | Knudsen | 248/188.3 |

* cited by examiner

*Primary Examiner* — Janet M Wilkens

(57) ABSTRACT

The specialized table apparatus provides for a child to be positioned in the center of the table top, with various toys and devices placed around them on the table top. The removably fitted table top corrals toys and other devices within the side rails that extend above the table top, thereby helping to prevent a child from inadvertently knocking devices off of the apparatus. The L-shaped legs provide for greater stability and for greater support of the table top and the house that is selectively fitted atop the table top. Various surfaces of the apparatus are provided in both erasable surfaces and magnetic surfaces. A storage area is provided adjacent to one side.

7 Claims, 5 Drawing Sheets

SPECIALIZED TABLE APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Children play a host of games and play with a plethora of toys and devices upon table tops and the like. What adults find easy to reach, though, is often totally out of reach for a child, a fact that requires constant movement around various play devices on a surface, if such movement is possible. The present apparatus provides for full involvement of a child, in almost any chosen tabletop activity, without reach limitation and constant table circling, and also provides the child with additional play possibilities.

FIELD OF THE INVENTION

The specialized table apparatus relates to tables and more especially to a table specialized for a child's care and enjoyment and the enjoyment of the caregivers.

SUMMARY OF THE INVENTION

The general purpose of the specialized table apparatus, described subsequently in greater detail, is to provide a specialized table apparatus which has many novel features that result in an improved specialized table apparatus which is not anticipated, rendered obvious, suggested, or even implied by prior art, either alone or in combination thereof.

To attain this, the specialized table apparatus provides for a child to be positioned in the center of the table top, with various toys and devices placed around them on the table top. Importantly, the table top, when fitted, corrals toys and other devices within the side rails that extend above the table top, thereby helping to prevent a child from inadvertently knocking devices off of the apparatus. When desired, the apparatus may also feature a solid table top, for use with toy trains for example, and enjoyment from without the perimeters of the table top. The apparatus may provide L-shaped legs for greater stability and for greater support of the table top and the house. Importantly, the apparatus provides legs and not a base, and the legs are dispersed to the far corners for both stability and so that the apparatus may be easily fitted into a variety of spaces and even overlap many various obstacles. Of further importance is that no obstacle is placed in the way of a child, such as a support seat for example, so that the child has complete freedom of movement within the confines of the table top cutout.

The table top and even exterior of the side rails may be fitted with a surface that provides for erasability and also for magnetic attraction, as various toys of numbers, alphabets, and the like are often magnetic, for example. The storage area may provide for convenient and accessible storage of various tools and playthings.

The selectively fitted house is removably disposed atop the table top. The house may include interior surfaces with erasability and magnetic attraction, like the table top. Importantly, the house may be three-sided to allow external viewing by a child and internal viewing by caregivers.

Thus has been broadly outlined the more important features of the improved specialized table apparatus so that the detailed description thereof that follows may be better understood and in order that the present contribution to the art may be better appreciated.

An object of the specialized table apparatus is to provide play surfaces for a child.

Another object of the specialized table apparatus is to virtually all play surfaces are reachable by a child without the child having to move around the surfaces.

A further object of the specialized table apparatus is to provide magnetic surfaces.

An added object of the specialized table apparatus is to provide erasable marking surfaces.

And, an object of the specialized table apparatus is to provide interchangeable play devices.

Yet another object of the specialized table apparatus is to provide for implement storage.

An added object of the specialized table apparatus is to corral toys and other devices within the side rails upon the table top.

These together with additional objects, features and advantages of the improved specialized table apparatus will be readily apparent to those of ordinary skill in the art upon reading the following detailed description of presently preferred, but nonetheless illustrative, embodiments of the improved specialized table apparatus when taken in conjunction with the accompanying drawings.

In this respect, before explaining the current embodiments of the improved specialized table apparatus in detail, it is to be understood that the specialized table apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved specialized table apparatus. It is therefore important that the claims be regarded as including such equivalent constructions insofar as they do not depart from the spirit and scope of the specialized table apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 6 thereof, the principles and concepts of the specialized table apparatus generally designated by the reference number 10 will be described.

Figure 1:
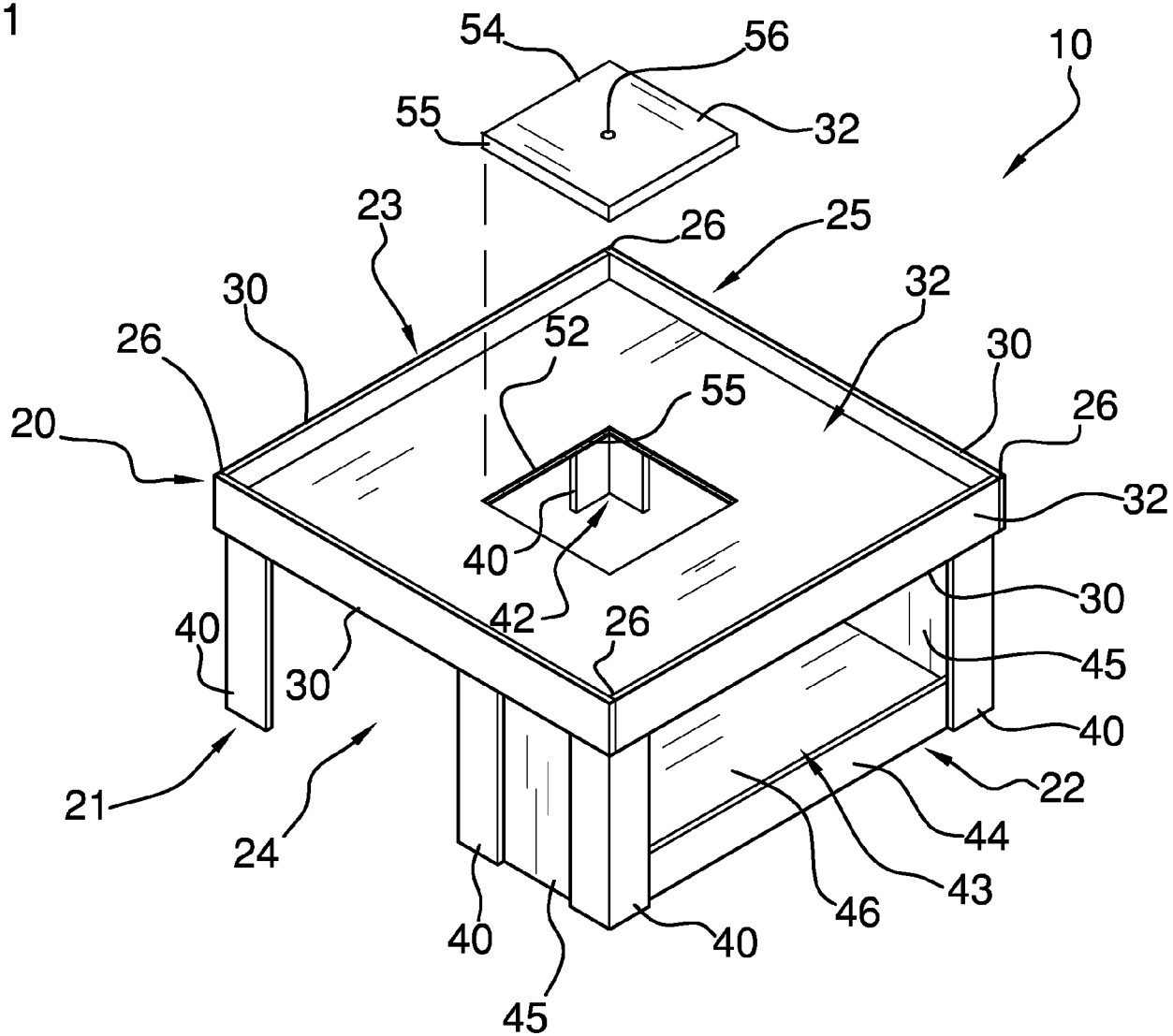
FIG. 1 is a top perspective view affixed with the removable table top with cutout.

Referring to FIG. 1, the apparatus 10 partially comprises a top 20 spaced apart from a bottom 21. The apparatus 10 further comprises a quartet of spaced apart sides comprising a first side 22 spaced apart from the second side 23, and a third side 24 spaced apart from the fourth side 25. A corner 26 is disposed at a juncture of each of the adjoining sides.

Figure 5:
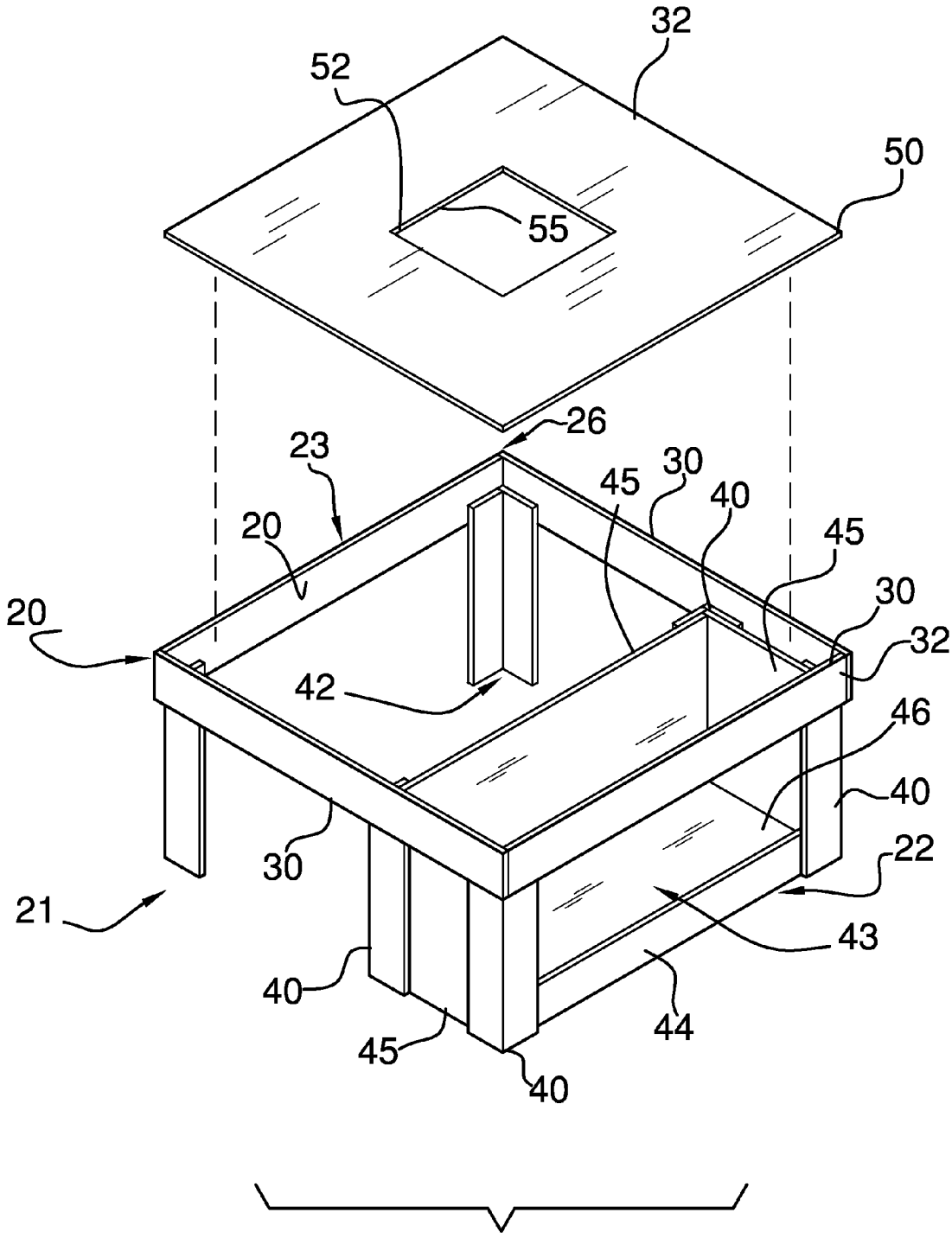
FIG. 5 is a top perspective view with table top with cutout removed.

Referring to FIG. 5, a sextet of L-shaped legs 40 is provided. Each L-shaped leg 40 is extended from the bottom 21 to proximal to the top 20. One of each L-shaped leg 40 is fitted within one of each of the corners 26.

Each L-shaped leg 40 has a leg interior 42 facing inwardly. One of the L-shaped legs 40 is fitted within the third side 24, most proximal to the first side 22. The third side 24 leg interior 42 faces the first side 22 and the fourth side 25. One of the L-shaped legs 40 is fitted within the fourth side 25 most proximal to the first side 22. The fourth side 25 leg interior 42 faces the first side 22 and the third side 24. The quartet of vertically disposed side rails 30 connects the corners 26. The side rails 30 reach the top 20. The side rails 30 extend slightly above the L-shaped legs 40.

Figure 3:
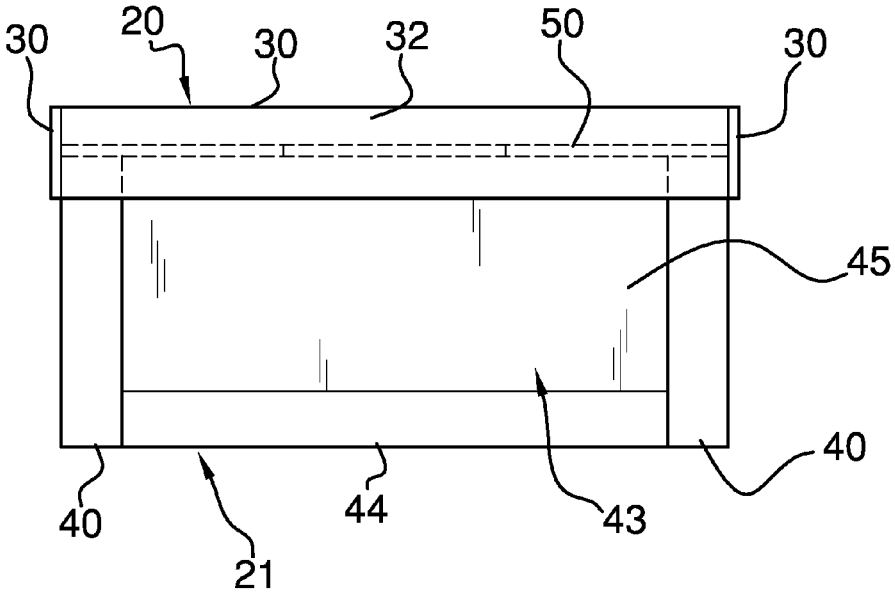
FIG. 3 is a side elevation view.

Referring to FIG. 3, a magnetic surface 32 is disposed exteriorly on each side rail 30 so that various magnetic devices and toys can selectively adhere to the surface 32. The border 44 is disposed interiorly at the bottom 21 between the corner 26 of the first side 22 and third side 24 and the corner 26 of the first side 22 and fourth side 25. The border 44 is extended slightly upward from the bottom 21 toward the top 20.

Referring again to FIG. 5, a trio of interior borders 45 is provided. One interior border 45 is disposed between the first side 22 and third side 24 corner 26 and the L-shaped leg 40 within the third side 24. One interior border 45 is disposed between the first side 22 and the fourth side 25 and the L-shaped leg 40 within the fourth side 25. One interior border 45 is disposed between the L-shaped leg 40 within the third side 24 and the L-shaped leg 40 within the fourth side 25. The interior borders 45 are extended to proximal to the top 20, even with the legs 40 proximal to the top 20. The floor 46 is disposed between the interior borders 45 and the border 44 at the bottom 21.

Referring to FIG. 4 and again to FIGS. 1 and 5, the table top 50 is removably disposed within the side rails 30 and atop the L-shaped legs 40. The illustrated table top 50 features a surface 32 providing erasability. The cutout 52 is disposed centrally within the table top 50. The fill 54 is removably disposed within the cutout 52. A finger hole 56 is disposed within the cutout 52 to aid in removal and installation. Several means may be used to retain the fill 54 flushly within the cutout 52, and among those is the featured bevel 55 disposed on each.

Figure 2:
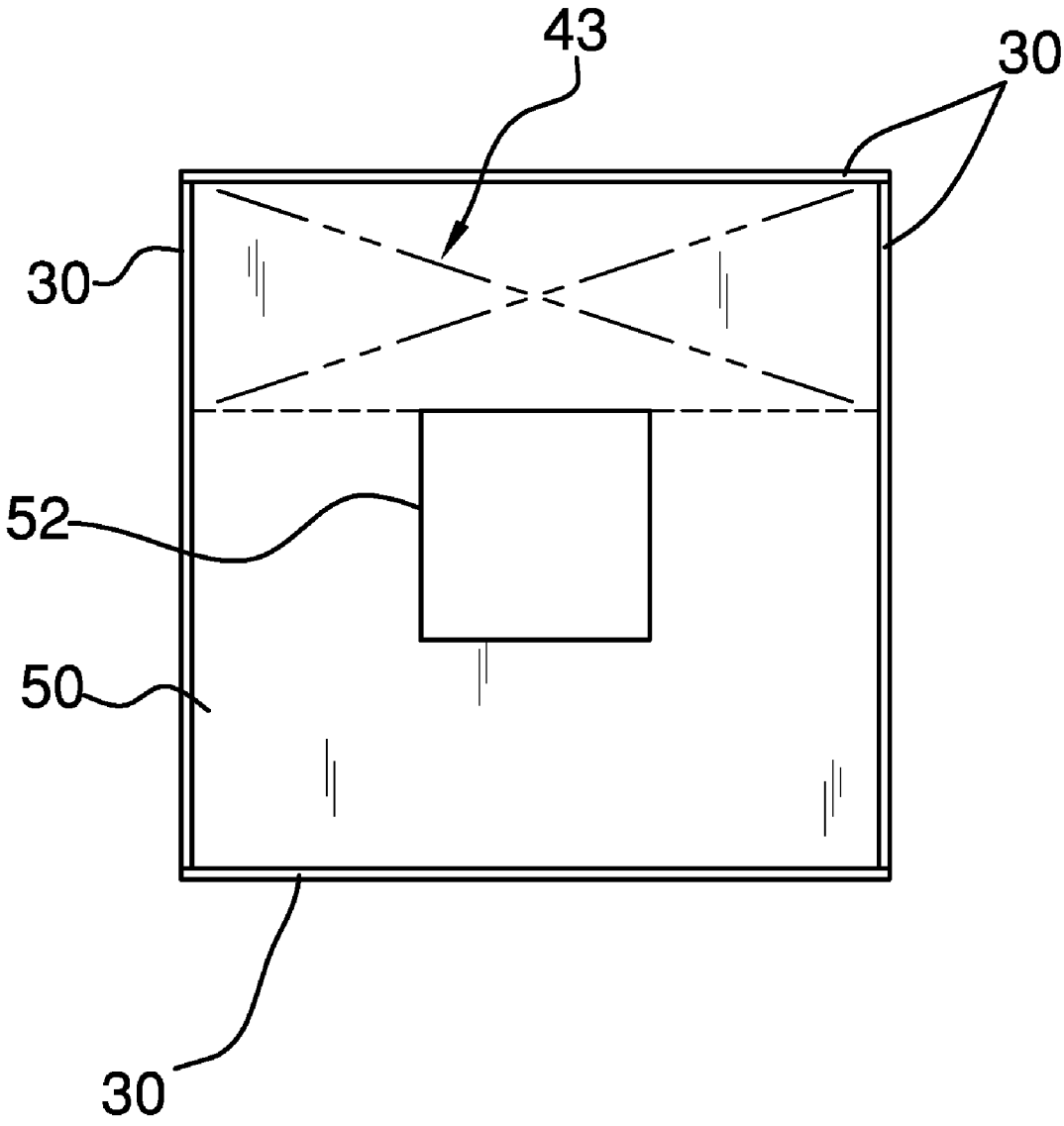
FIG. 2 is a top plan view of FIG. 1.
Figure 4:
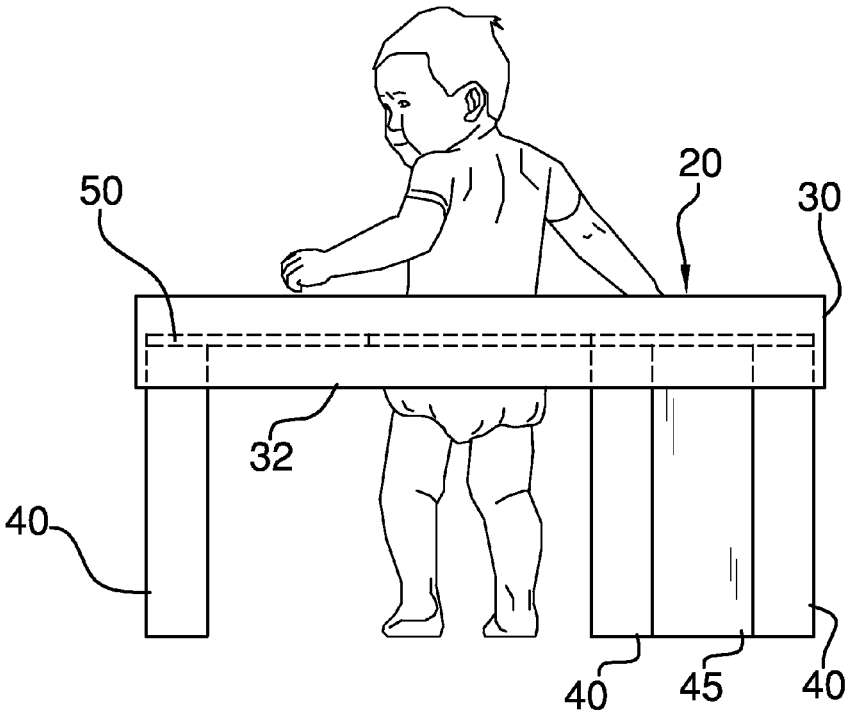
FIG. 4 is a side elevation view in use.

Referring to FIGS. 2 and 4, the storage area 43 does not encroach upon the cutout 52 and therefore does not encroach upon a child held within.

Figure 6:
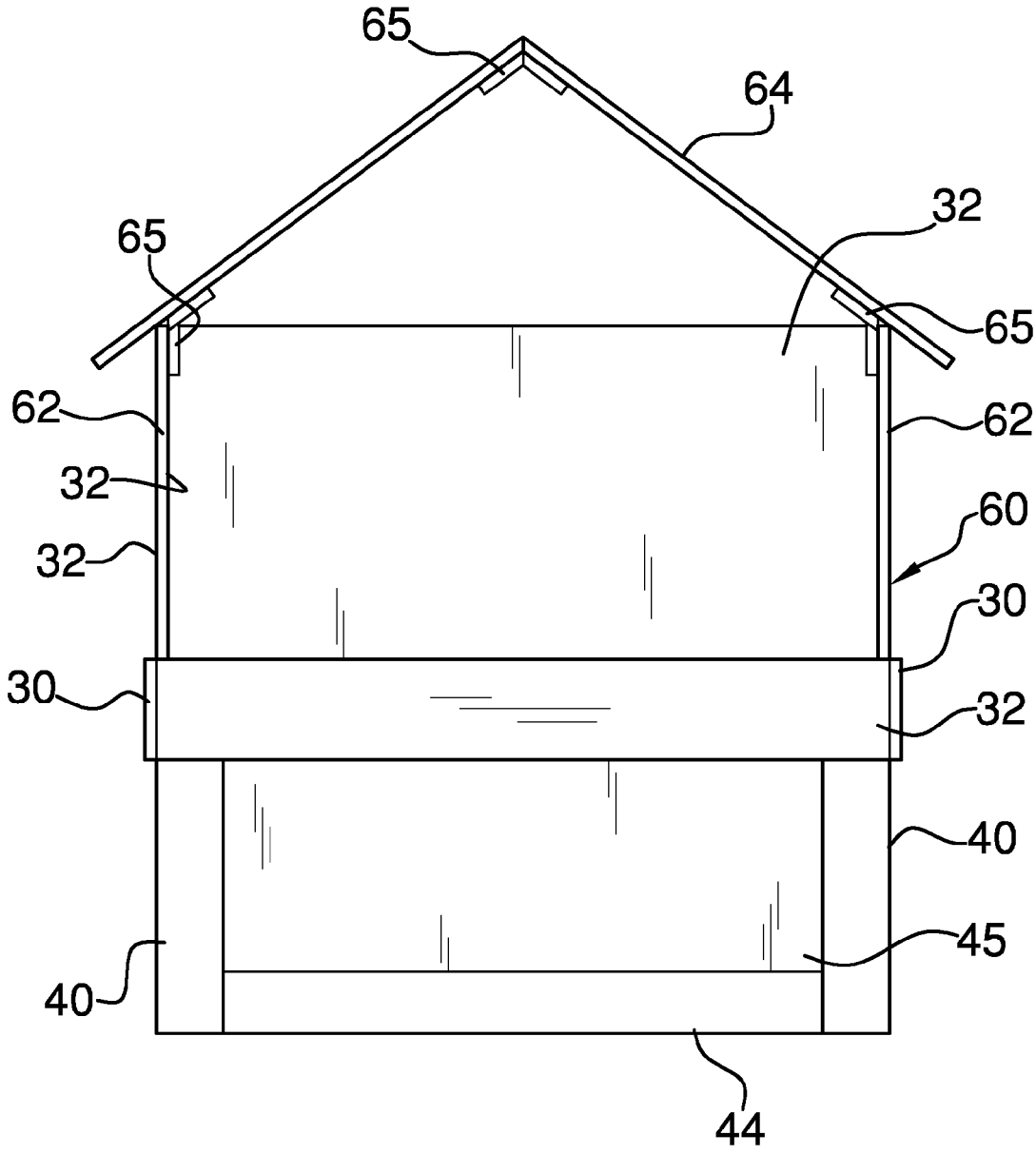
FIG. 6 is a side elevation view with house removably fitted.

Referring to FIG. 6, the apparatus 10 also partially comprises the three-sided house 60 removably disposed atop the table top 50. Three walls 62 allow viewing for a caregiver and an un-trapped feeling for any child within. The walls 62 may feature surfaces 32 providing erasability and magnetic surfaces 32. The roof 64 is disposed atop the three sided house 60. The surface 32 is disposed interiorly on the three-sided house 60. The plurality of 60 degree supports 65 supports the roof 64 atop the house 60. With all supports 65 being 60 degrees, the child selectively placed within the table top 50 is not excessively confined, and production costs are lessened as opposed to differing angles of supports 65.

The combination of such claimed elements provides an unpredictable and unexpected result that is not rendered obvious by one skilled in the art. The cutout 52 within the table top 50 provides that the apparatus 10 be used to safely contain a toddler, just as a legged stroller or other such device might, yet still provide entertainment beyond what is typically available to the toddler.

With respect to the above description then, it is to be realized that the optimum dimensional relationships for the parts of the specialized table apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the specialized table apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the specialized table apparatus may be used.

Therefore, the foregoing is considered as illustrative only of the principles of the specialized table apparatus. Further, since numerous modifications and changes will readily occur to those skilled in the art, it is not desired to limit the specialized table apparatus to the exact construction and operation shown and described, and accordingly, all suitable modifications and equivalents may be resorted to, falling within the scope of the specialized table apparatus.

What is claimed is:

1. A specialized table apparatus comprising, in combination:

a top spaced apart from a bottom, a quartet of spaced apart sides comprising a first side spaced apart from a second side, a third side spaced apart from a fourth side, a corner at a juncture of each of the adjoining sides;

a sextet of legs, each leg extended from the bottom to proximal to the top, one of each leg fitted within one of each of the corners, each leg having a leg interior facing inwardly, one of the legs fitted within the third side, most proximal to the first side, the third side leg interior facing the first side and the fourth side, one of legs fitted within the fourth side most proximal to the first side, the fourth side leg interior facing the first side and the third side;

a quartet of vertically disposed side rails connecting the corners, the side rails reaching the top, the side rails extended slightly above the legs;

a magnetic surface disposed exteriorly on each side rail;

a border disposed interiorly at the bottom between the corner of the first side and third side and the corner of the first side and fourth side, the border extended slightly upward from the bottom toward the top;

a trio of interior borders, one interior border disposed between the first side and third side corner and the leg within the third side, one interior border disposed between the first side and the fourth side and the leg within the fourth side, one interior border disposed between the leg within the third side and the leg within the fourth side, the interior borders extended to proximal to the top, evenly with the legs proximal to the top;

a floor disposed between the interior borders and the border at the bottom;

a table top removably disposed within the side rails, atop the legs, the table top disposed below the top;

a cutout disposed centrally within the table top.

2. The apparatus according to claim 1 further comprising a fill removably disposed within the cutout;

a finger hole disposed within the fill.

3. The apparatus according to claim 2 wherein the cutout and the fill each further comprise a bevel whereby the fill is selectively and flushly disposed within the cutout.

4. A specialized table apparatus comprising, in combination:

a top spaced apart from a bottom, a quartet of spaced apart sides comprising a first side spaced apart from a second side, a third side spaced apart from a fourth side, a corner at a juncture of each of the adjoining sides;

a sextet of L-shaped legs, each leg extended from the bottom to proximal to the top, one of each L-shaped leg fitted within one of each of the corners, each L-shaped leg having a leg interior facing inwardly, one of the L-shaped legs fitted within the third side, most proximal to the first side, the third side leg interior facing the first side and the fourth side, one of the L-shaped legs fitted within the fourth side most proximal to the first side, the fourth side leg interior facing the first side and the third side;

a quartet of vertically disposed side rails connecting the corners, the side rails reaching the top, the side rails extended slightly above the L-shaped legs;

a magnetic surface disposed exteriorly on each side rail;

a border disposed interiorly at the bottom between the corner of the first side and third side and the corner of the first side and fourth side, the border extended slightly upward from the bottom toward the top;

a trio of interior borders, one interior border disposed between the first side and third side corner and the L-shaped leg within the third side, one interior border disposed between the first side and the fourth side and the L-shaped leg within the fourth side, one interior border disposed between the L-shaped leg within the third side and the L-shaped leg within the fourth side, the interior borders extended to proximal to the top, even with the L-shaped legs proximal to the top;

a floor disposed between the interior borders and the border at the bottom;

a table top removably disposed within the side rails, atop the L-shaped legs, the table top disposed below the top;

a cutout disposed centrally within the table top.

5. The apparatus according to claim 4 further comprising a fill removably disposed within the cutout;

a finger hole disposed within the fill.

6. The apparatus according to claim 5 wherein the cutout and the fill each further comprise a bevel whereby the fill is selectively and flushly disposed within the cutout.

7. A specialized table apparatus comprising, in combination:

a top spaced apart from a bottom, a quartet of spaced apart sides comprising a first side spaced apart from a second side, a third side spaced apart from a fourth side, a corner at a juncture of each of the adjoining sides;

a sextet of L-shaped legs, each L-shaped leg extended from the bottom to proximal to the top, one of each L-shaped leg fitted within one of each of the corners, each L-shaped leg having a leg interior facing inwardly, one of the L-shaped legs fitted within the third side, most proximal to the first side, the third side leg interior facing the first side and the fourth side, one of the L-shaped legs fitted within the fourth side most proximal to the first side, the fourth side leg interior facing the first side and the third side;

a quartet of vertically disposed side rails connecting the corners, the side rails reaching the top, the side rails extended slightly above the L-shaped legs;

a magnetic surface disposed exteriorly on each side rail;

a border disposed interiorly at the bottom between the corner of the first side and third side and the corner of the first side and fourth side, the border extended slightly upward from the bottom toward the top;

a trio of interior borders, one interior border disposed between the first side and third side corner and the L-shaped leg within the third side, one interior border disposed between the first side and the fourth side and the L-shaped leg within the fourth side, one interior border disposed between the L-shaped leg within the third side and the L-shaped leg within the fourth side, the interior borders extended to proximal to the top, even with the legs proximal to the top;

a floor disposed between the interior borders and the border at the bottom;

a table top removably disposed within the side rails, atop the L-shaped legs;

a cutout disposed centrally within the table top;

a fill removably disposed within the cutout;

a bevel disposed on the cutout and on the fill whereby the fill is selectively and flushly fitted from above into the cutout;

a finger hole disposed within the fill;

a three-sided house removably disposed atop the table top;

a roof disposed atop the three sided house;

a surface disposed interiorly on the three-sided house;

a plurality of 60 degree supports supporting the roof atop the house.

* * * * *